US008291644B2

(12) United States Patent
Plavnik et al.

(10) Patent No.: US 8,291,644 B2
(45) Date of Patent: Oct. 23, 2012

(54) LOCKING MECHANISM FOR PNEUMATIC DIFFERENTIAL ENGINE FOR POWER-OPERATED DOORS

(75) Inventors: Gennady Plavnik, Indian Creek, IL (US); Frank Golemis, Skokie, IL (US); Michael O'Neill, Round Lake Beach, IL (US); David C. Griffis, Round Lake, IL (US); Peter Heidrich, Des Plaines, IL (US)

(73) Assignee: Wabtec Holding Corp., Wilmerding, PA (US)

( * ) Notice: Subject to any disclaimer, the term of this patent is extended or adjusted under 35 U.S.C. 154(b) by 345 days.

(21) Appl. No.: 12/595,861

(22) PCT Filed: May 1, 2008

(86) PCT No.: PCT/US2008/062226

§ 371 (c)(1),
(2), (4) Date: Mar. 3, 2010

(87) PCT Pub. No.: WO2008/137550

PCT Pub. Date: Nov. 13, 2008

(65) Prior Publication Data

US 2010/0199564 A1 Aug. 12, 2010

Related U.S. Application Data

(60) Provisional application No. 60/927,418, filed on May 3, 2007.

(51) Int. Cl.
*E05F 15/02* (2006.01)

(52) U.S. Cl. ..... 49/340; 49/141; 49/341; 49/344

(58) Field of Classification Search ..... 49/141, 49/339, 340, 341, 342, 344
See application file for complete search history.

(56) References Cited

U.S. PATENT DOCUMENTS

| | | | | |
|---|---|---|---|---|
| 1,980,617 | A | 11/1934 | Engel | |
| 4,134,231 | A | 1/1979 | Daugirdas et al. | |
| 4,660,250 | A * | 4/1987 | Tillman et al. | 16/58 |
| 4,999,872 | A * | 3/1991 | Jentsch | 16/58 |
| 5,513,467 | A * | 5/1996 | Current et al. | 49/340 |
| 5,687,507 | A * | 11/1997 | Beran | 49/340 |
| 6,442,795 | B1 * | 9/2002 | Chen | 16/53 |
| 6,715,453 | B2 | 4/2004 | Tomatsuri et al. | |
| 7,571,515 | B2 * | 8/2009 | Fischbach et al. | 16/79 |
| 2005/0132652 | A1 | 6/2005 | Tong et al. | |

* cited by examiner

*Primary Examiner* — Jerry Redman
(74) *Attorney, Agent, or Firm* — The Webb Law Firm

(57) ABSTRACT

A locking mechanism (100) for use with a pneumatic cylinder/differential engine for a power-operated door including a locking rod (20), a plunger (24) associated with the locking rod (20) to cause extension and retraction of the locking rod (20) with respect to a door opening/closing gear (46), and a spring member (34) associated with the plunger (24) for maintaining the plunger (24) and the locking rod (20) in an extended position during a door closed position. An aperture (46*a*) is located through a sidewall portion of the gear hub (46*b*) which is capable of receiving an end (20*a*) of the locking rod (20) when the locking rod is in an extended position to lock the door in a door closed position. The invention also includes an emergency door opening mechanism enabling manual opening of the doors in case of an emergency.

18 Claims, 18 Drawing Sheets

LOCKING MECHANISM FOR PNEUMATIC DIFFERENTIAL ENGINE FOR POWER-OPERATED DOORS

CROSS REFERENCE TO RELATED APPLICATIONS

This application claims the benefit of U.S. Provisional Patent Application No. 60/927,418, filed May 3, 2007, and entitled "Locking Mechanism for Pneumatic Differential Engine for Power-Operated Doors", the entire disclosure of which is incorporated herein in its entirety.

BACKGROUND OF THE INVENTION

1. Field of the Invention

This application relates in general to a locking mechanism for a pneumatic differential engine for power-operated doors and, more particularly, to a mechanical locking device for maintaining the differential engine in the "door closed" position, as well as an emergency door-opening device enabling manual opening of the doors.

2. Description of Related Art

Pneumatic cylinders have been utilized in mechanical systems to convert compressed air into linear reciprocating movement for opening and closing doors of passenger transportation vehicles. An example of this type of door actuating system is shown in U.S. Pat. No. 3,979,790.

Typically, pneumatic cylinders used in this environment consist of a cylindrical chamber, a piston and two end caps hermetically connected to the cylindrical chamber. The end caps have holes extending therethrough to allow the compressed air to flow into and out of the cylindrical chamber, to cause the piston to move in a linear direction, and to apply either an opening or closing force to the vehicle door.

Pneumatic cylinder/differential engine systems have also been designed for opening and closing doors of passenger transportation vehicles. Examples of these systems are shown in U.S. Pat. Nos. 4,231,192; 4,134,231; and 1,557,684. None of these currently used systems have a locking system for locking the doors in a closed position should the system experience a loss of air supply pressure.

To understand the locking mechanism of the present invention, it may be helpful to understand how a pneumatically powered differential engine door opening device operates.

Reference is now made to FIG. 1, which schematically shows a pneumatically-powered differential engine door opening device. The differential engine includes a housing comprising a large diameter cylinder 1 and a small diameter cylinder 2, closed at their ends by large cap 6 and small cap 7. A large diameter piston 4 is installed in the large cylinder 1 and a small diameter piston 5 is installed in the small cylinder 2. A toothed rack 16 is attached to and extends between the large piston 4 and small piston 5. The toothed rack 16 is engaged with a pinion gear 15. The pinion gear 15 is, in turn, connected to a shaft 14 which drives the mechanism for closing and opening the vehicle door. Linear movement of pistons 4 and 5 causes linear movement of the toothed rack 16. This linear movement is converted into rotational movement of the pinion gear 15 and shaft 14 causing opening and/or closing of the vehicle door. As viewed in FIG. 1, movement of the pistons 4 and 5 toward large cap 6 or to the left, causes an opening of the doors, and movement of pistons 4 and 5 toward small cap 7 or to the right, causes a closing of the doors.

As shown in FIG. 1, the outer side of the small cylinder 2 is connected through an opening 19 in the cap 7 to a reservoir of compressed air that constantly applies a positive pressure to the surface 5*a* of small piston 5 facing opening 19. As shown schematically in FIG. 1A, the large cap 6, attached to the outer end of the large cylinder 1, has a chamber 17 including holes 9 and 10 which are connected through a port 80 to a three-way valve, which provides connections to a source of compressed air and to an exhaust. During closing of the doors, hole 9 is connected to a source of pressurized air and exhaust hole 10 is closed. Because the surface area of piston 4 is greater than the surface area of piston 5, the pistons 4, 5 move toward small cap 7 or to the right as shown in FIG. 1, rotating the pinion gear 15/shaft 14 in a counter-clockwise direction. During an opening stroke, holes 9, 10 are connected to an exhaust, causing the air to flow out of large cylinder 1. Because the small piston 5 is constantly attached to a source of positive air pressure, the exhausting of the air pressure from within the large cylinder 1 causes the pistons 4, 5, connected by toothed rack 16, to move toward large cap 6 or toward the left as shown in FIG. 1, within the large and small cylinders 1, 2. This movement toward the large cap 6 rotates the pinion gear 15/shaft 14 in a clockwise direction to initiate opening of the doors.

It has been determined in some instances that there is a need to slow the movement of the piston at the end of the stroke when opening and/or closing the door. A known technique for slowing this stroke is by restricting the flow of the exhaust air out of the cylindrical chamber. This is commonly known as cushioning the movement of the piston.

In this design, cushioning at the end of the opening piston stroke occurs through the use of a small hole 11 having a diameter that is substantially smaller than that of opening 82. This hole 11 is located at a side surface of chamber 17, which provides connection to the inside volume of the chamber of the large cylinder 1. A cylindrical sealing disk 8 is installed between the piston 4 and cap 6 and is supported between two springs 12, 13. The movement of the pistons 4, 5 toward large cap 6 or to the left as shown in FIG. 1, causes compression of springs 12, 13 bringing the disk 8 into contact with a face 17*a* of chamber 17, forming a seal with the chamber face 17*a*. Once this seal is achieved, air can no longer exit the chamber of the large cylinder 1 through opening 82 into chamber 17 and, thus, can only exit through hole 11 into chamber 17. Since the diameter of hole 11 is smaller than the diameter of opening 82, the flow of the air out of the large cylinder 1 is restricted, consequently slowing down the speed of the opening piston stroke movement to the left and achieving a cushioning effect during opening of the doors.

U.S. Pat. No. 2,343,316 teaches a pneumatic cylinder/differential engine for power-operated doors, wherein cushioning occurs near the end of the piston stroke during closing of the doors in order to prevent slamming. In this device, cushioning occurs when a sealing disk contacts with the surface of a cap, causing the exhaust air to flow through a small hole which significantly reduces the rate of flow of the exhaust air from the cylinder housing and decreases the linear speed of the piston.

As stated above, currently used pneumatic differential engines for power-operated doors do not have a locking mechanism for locking the doors in a closed position. The capability of locking the differential engine in a "door closed" position would be highly desirable, as it would ensure that the doors remained closed even in the event of partial or complete loss of air-supply pressure.

SUMMARY OF THE INVENTION

It is therefore an object of the invention to provide a mechanical device for locking the pneumatic differential engine in a "door closed" position. It is a further object of the invention to provide a mechanical locking device for maintaining the doors in a "doors closed" position in the event of a partial or complete loss of air supply pressure. It is another object of the invention to provide an emergency door opening mechanism for unlocking the differential engine to enable manual opening of the doors in case of an emergency.

Accordingly, the present invention is directed to a locking mechanism for use with a pneumatic cylinder/differential engine power-operated door. The pneumatic cylinder/differential engine includes a pair of aligned cylinders and a pair of associated pistons having a rack and pinion assembly, including a gear. This rack and pinion assembly is connected between and controlled by movement of the associated pistons for opening and closing of the doors. The locking mechanism comprises a locking rod having a leading end and a trailing end. The trailing end of the locking rod is attached to the plunger of a linear actuating mechanism, such that movement of the plunger causes extension and retraction of the locking rod with respect to the gear. A spring member is associated with the plunger for maintaining the plunger and the locking rod in an extended position during a "door closed" position. An aperture is located through a sidewall portion of the gear. This aperture extends to the gear hub and has a predetermined size and shape capable of receiving the leading end of the locking rod when the locking rod is in an extended position to lock the door in a "door closed" position.

The present invention also includes an emergency door opening mechanism enabling manual opening of the doors in case of an emergency. The emergency door opening mechanism comprises a series of cams associated with the locking mechanism. An emergency cable is provided for applying a force to the series of cams in an emergency situation, causing the series of cams to rotate and the locking mechanism to be released. An air dump control lever is associated with the series of cams and an air dump valve, controlled by the air dump control lever, releases air pressure from the pneumatic cylinders upon rotation of the series of cams. This release of air pressure enables a manual opening of the doors.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures.

DETAILED DESCRIPTION OF THE INVENTION

Figure 1:
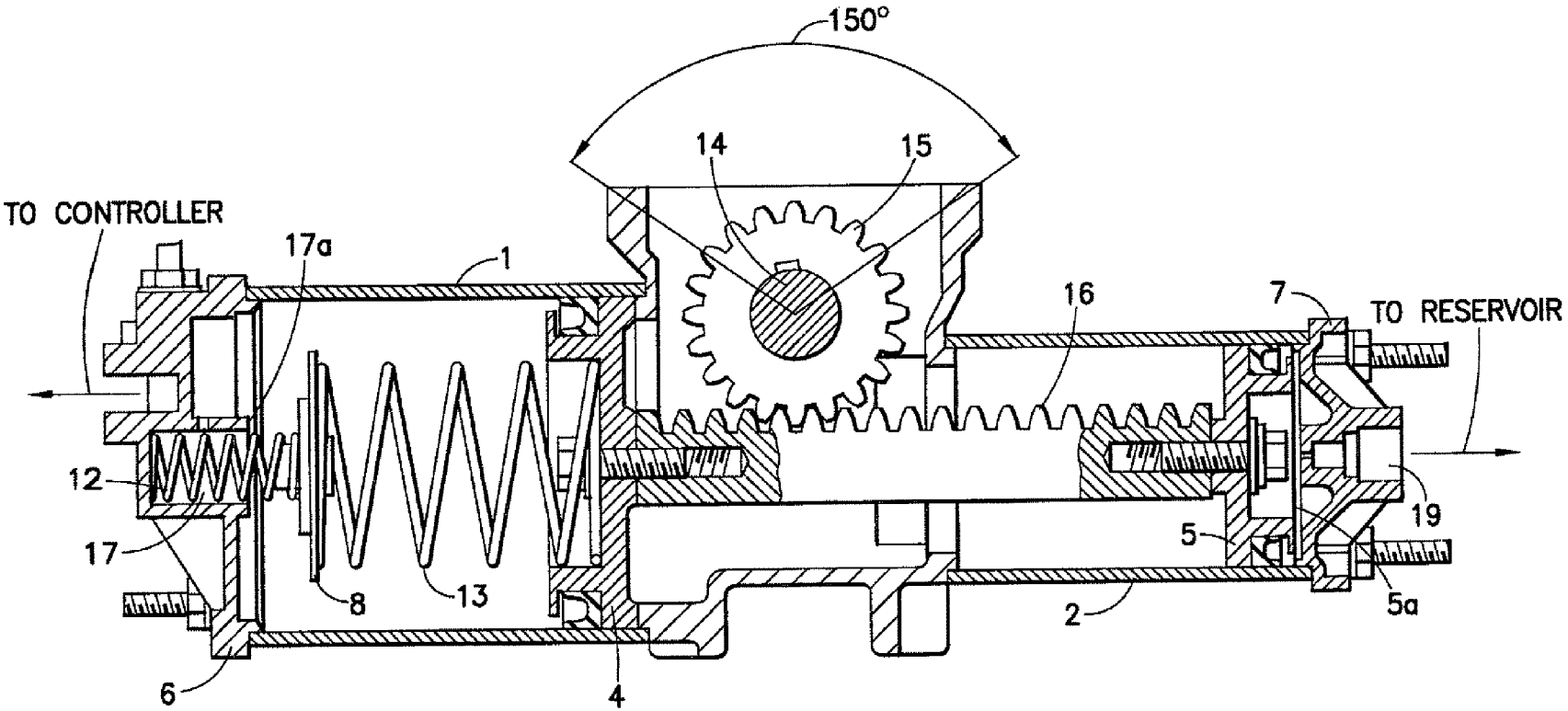
FIG. 1 PRIOR ART
FIG. 1 is a cross-sectional view of a pneumatic cylinder/differential engine of the prior art.
Figure 1A:
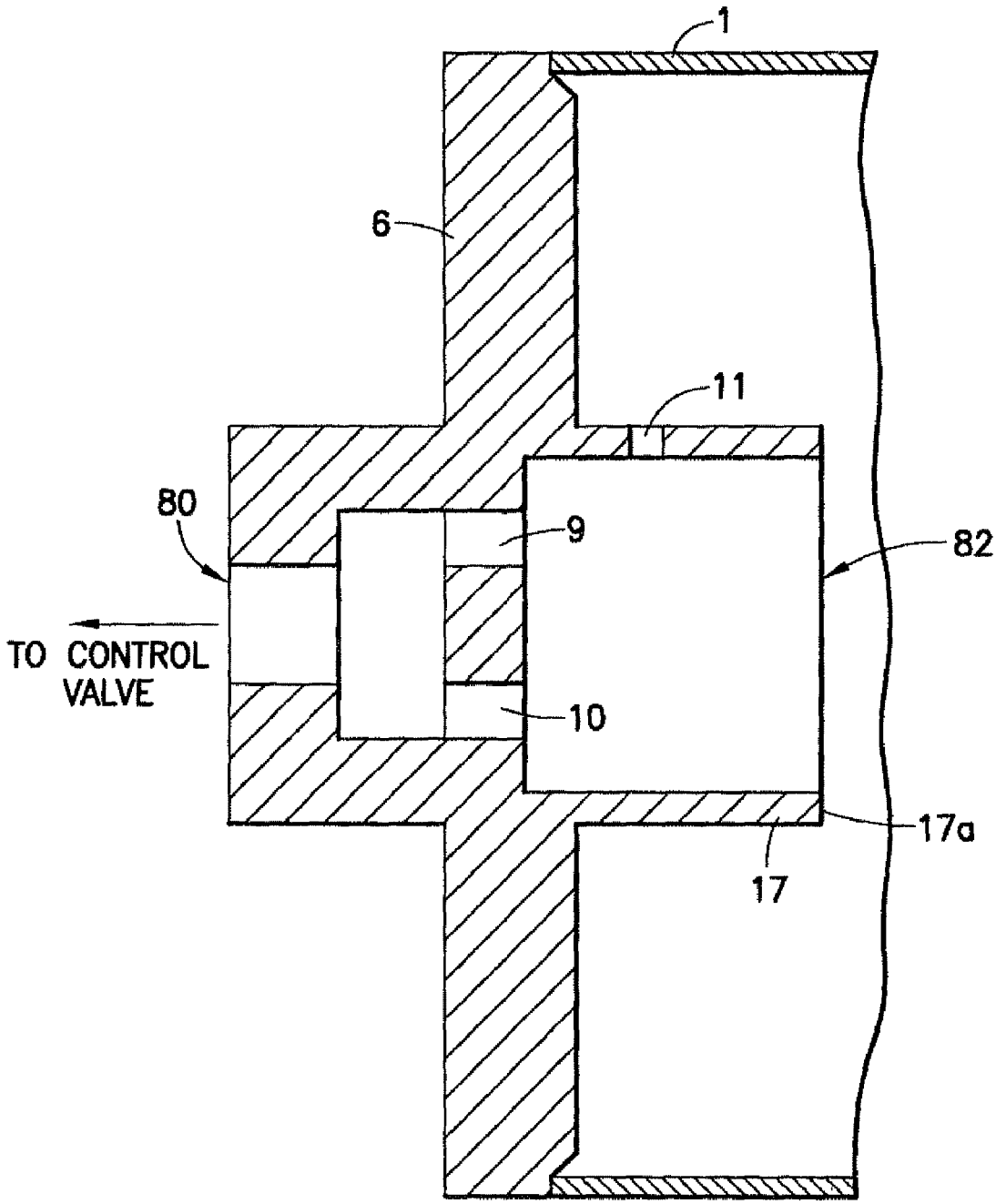
FIG. 1A PRIOR ART
FIG. 1A is a schematic view of the porting arrangement of the large cylinder end cap of the pneumatic cylinder/differential engine shown in FIG. 1.
Figure 2:
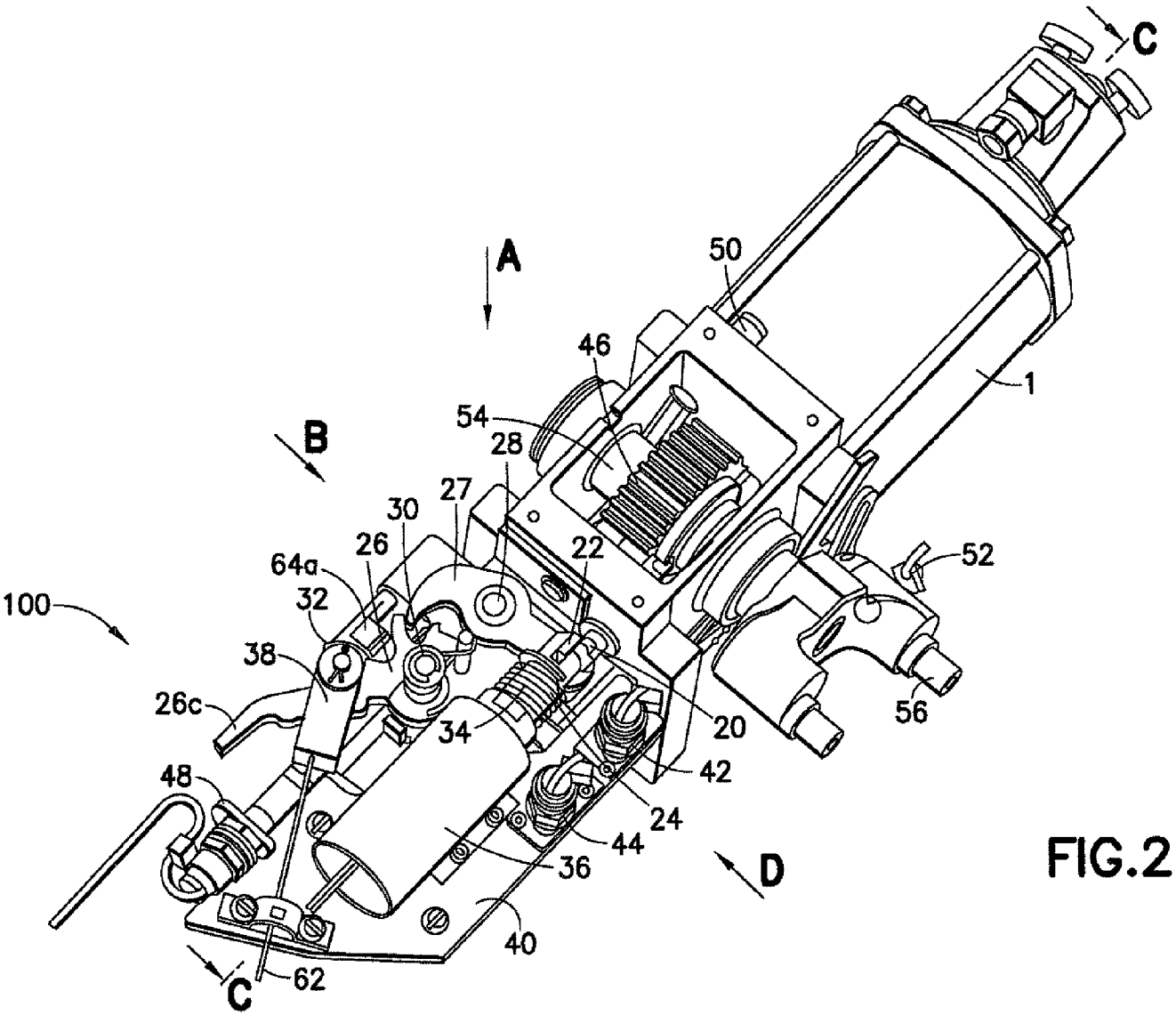
FIG. 2 is an isometric view of the differential engine of the present invention with the locking mechanism in the "door locked" position.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Reference is now made to FIGS. 2-6 which show the differential engine of the present invention with the locking mechanism generally illustrated as 100, in the "doors locked" position. The locking mechanism 100 of the present invention can be used in combination with any pneumatic cylinder/differential engine, such as the type shown in FIG. 1 and discussed in detail above. The locking mechanism 100 may be attached above the small cylinder 2 of the pneumatic cylinder/differential engine by a bracket 40 or any other well-known attaching device. This pneumatic cylinder/differential engine includes a pair of aligned cylinders 1, 2 and a pair of associated pistons 4, 5 having a rack 16 and pinion assembly including a modified gear 46. The output shaft 14 of the gear 15, 46 is connected to a teeter lever 56. The rack 16 and pinion assembly is connected between and controlled by movement of the associated pistons 4, 5, which are connected to the teeter lever 56, which causes opening and closing of the doors. The locking mechanism 100 comprises a locking rod 20 having a leading end 20*a* and a trailing end 20*b*. A solenoid plunger 24 is attached to the trailing end 20*b* of the locking rod 20, such that movement of the plunger 24 causes extension and retraction of the locking rod 20 with respect to the gear 46. A compression spring member 34 is associated with the plunger 24 for maintaining the plunger 24 and the locking rod 20 in an extended position during a "door closed" position. The modified gear 46 is provided with an aperture 46*a* located through a sidewall portion of the gear hub 46*b* and forming a contact surface 46*c* within the gear hub 46*b*. This aperture 46*a* has a predetermined size and shape capable of receiving the leading end 20*a* of the locking rod 20 when the locking rod 20 is in an extended position to lock the gear in a "door closed" position.

Figure 3:
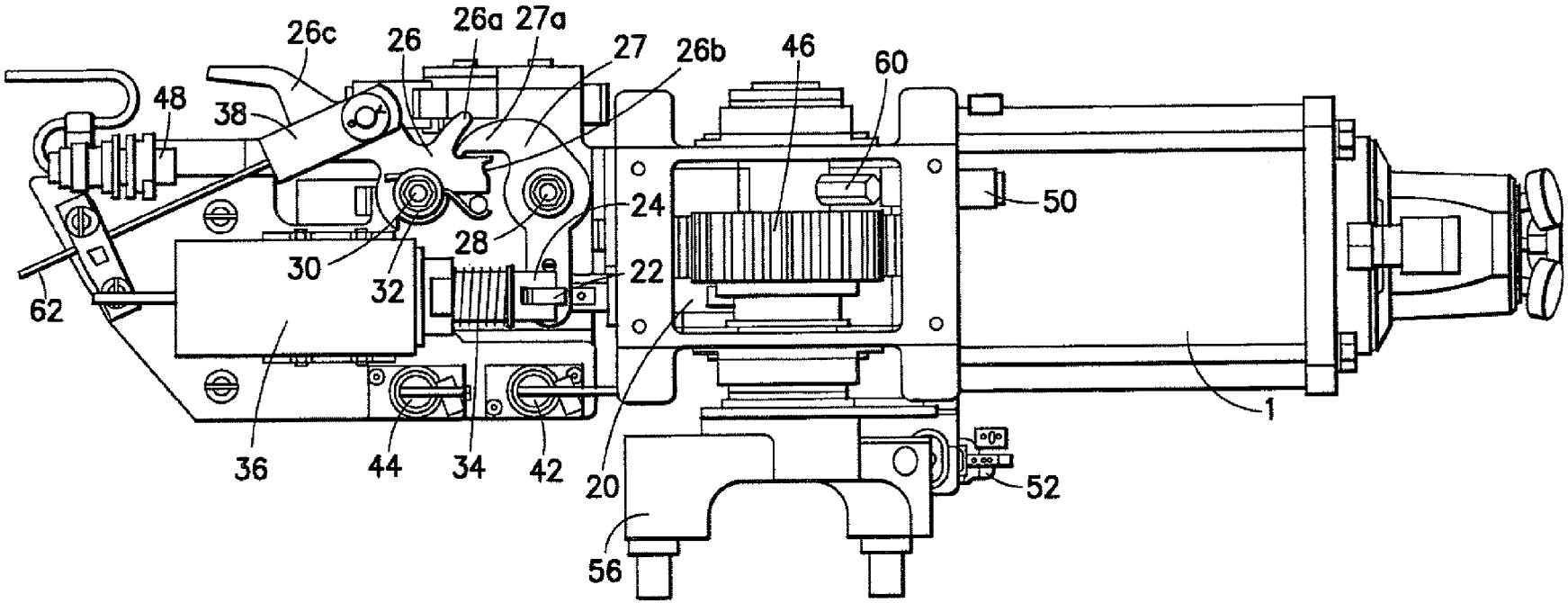
FIG. 3 is a top view "A" in the direction of the arrow "A" of FIG. 2 of the differential engine with the locking mechanism in the "doors locked" position.

An adapter 22 is provided for connecting the trailing end 20*b* of the locking rod 20 to the plunger 24. The plunger 24 extends from an unlocking actuating mechanism such as a solenoid assembly 36, as shown in FIG. 3, which is mounted to the pneumatic cylinder/differential engine. The compression spring member 34 maintains the plunger 24 and locking rod 20 in an extended position to ensure locking of the doors. The solenoid assembly 36 contains a solenoid therein which can receive a door opening signal which, in turn, causes the solenoid to be energized and the plunger 24 with the locking rod 20 to be retracted from the gear 46.

Figure 3A:
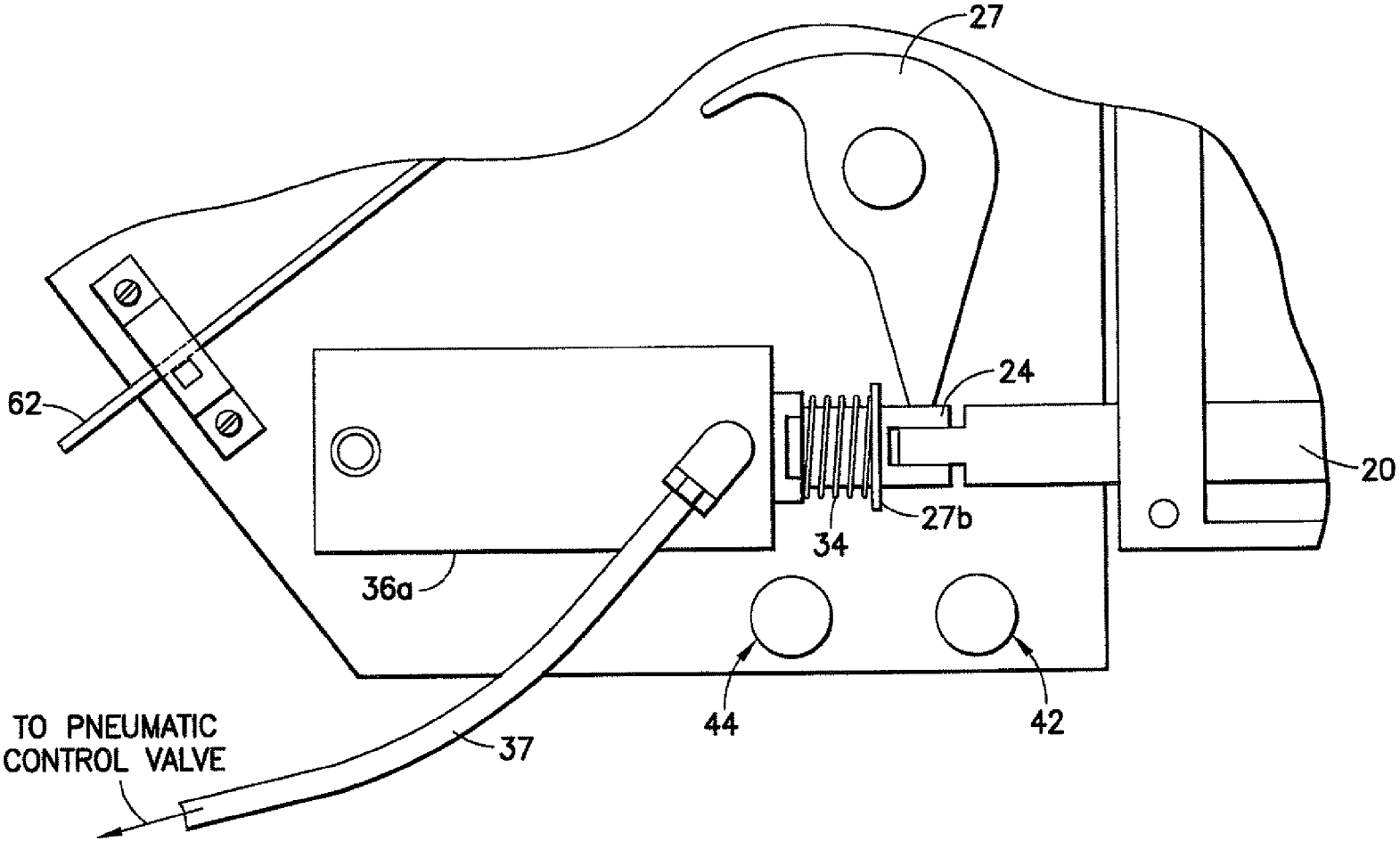
FIG. 3A is a partial schematic top view "A" in the direction of arrow "A" of FIG. 2 of an alternative design of the unlocking actuator for the differential engine with the locking mechanism in the "doors locked" position.
Figure 4:
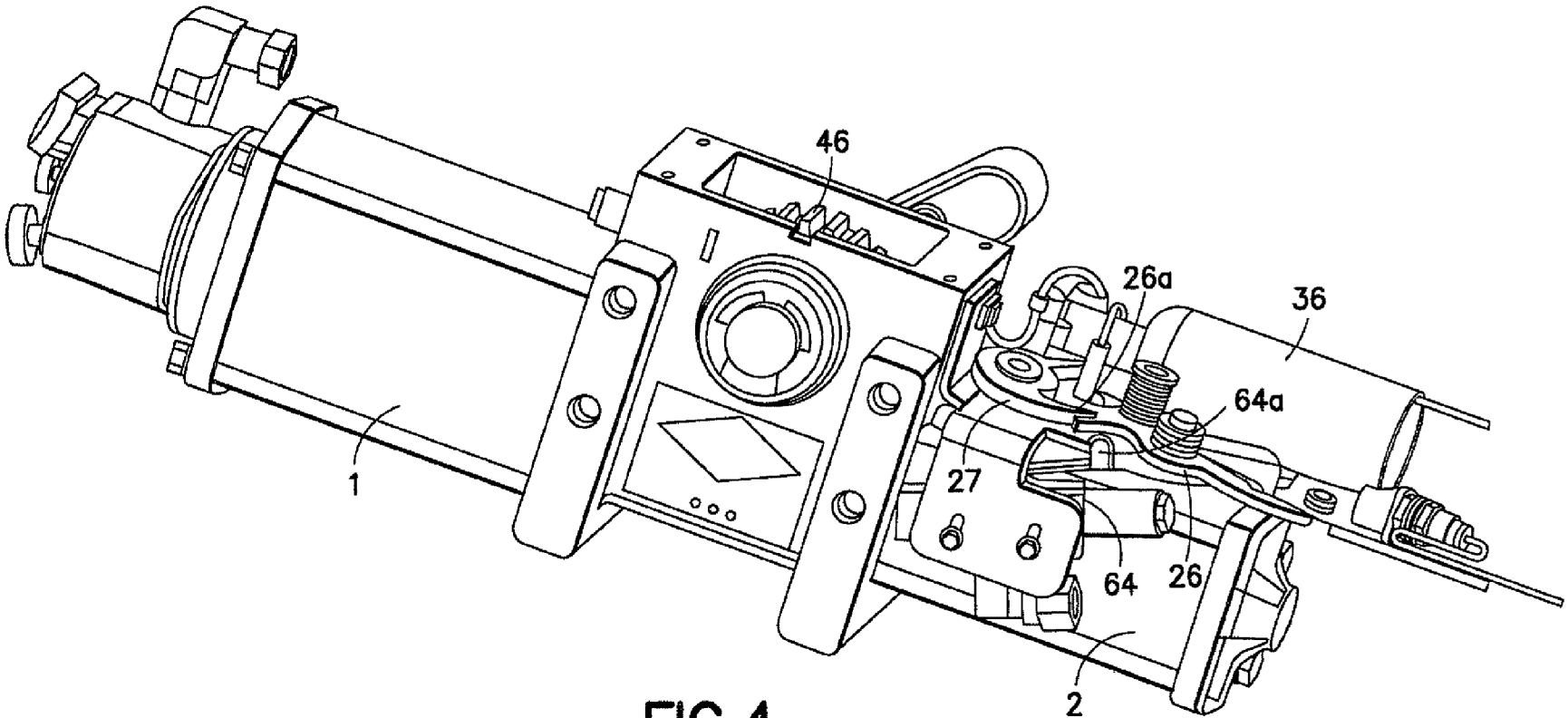
FIG. 4 is a back view "B" in the direction of the arrow "B" of FIG. 2 of the differential engine with the locking mechanism in the "doors locked" position.

According to an alternative design, as shown in FIG. 3A, the unlocking actuating mechanism can comprise a single-acting pneumatic cylinder 36*a* which is actuated by an air supply line 37 connected to a pneumatic control valve. The single-acting pneumatic cylinder 36*a* includes either an internal or external return spring (not shown) and suitable control valves.

The solenoid assembly 36 and single-acting pneumatic cylinder 36*a* of FIGS. 3 and 3A, show two examples of unlocking actuating mechanisms that can be used in the present invention. However, any type of linear actuating mechanism can be used in the present invention to cause the plunger 24 with the locking rod 20 to be retracted from the gear 46.

A better understanding of the invention can be had by understanding the functioning of the mechanism for the various door positions, as described in detail below.

In the "doors closed" position of the differential engine 100, the solenoid of the solenoid assembly 36 is not energized. The compression spring 34 pushes the plunger 24 and the locking rod 20, attached to the plunger 24 by adapter 22 to the right, as viewed in FIGS. 2-6, in a radial direction relative to the center of the gear 46 until the locking rod will enter into the aperture 46*a* of the gear hub 46*b* and contact the surface 46*c* of the gear hub 46*b*. In this position, the gear 46 will be locked against the possibility of rotation, and this locking action will be simultaneously applied to an output shaft 54, teeter lever 56 and other linkage elements (not shown in the drawings) connecting the differential engine with the vehicle doors. Locking of the differential engine output shaft 54 prevents the engine from moving the vehicle doors. The "doors closed" proximity switch 50 generates a signal that indicates that the differential engine is in the "doors closed" position. A target 66, connected to the locking rod 20, activates the "doors locked" proximity switch 42, which generates a signal that indicates that the differential engine is locked.

Figure 5:
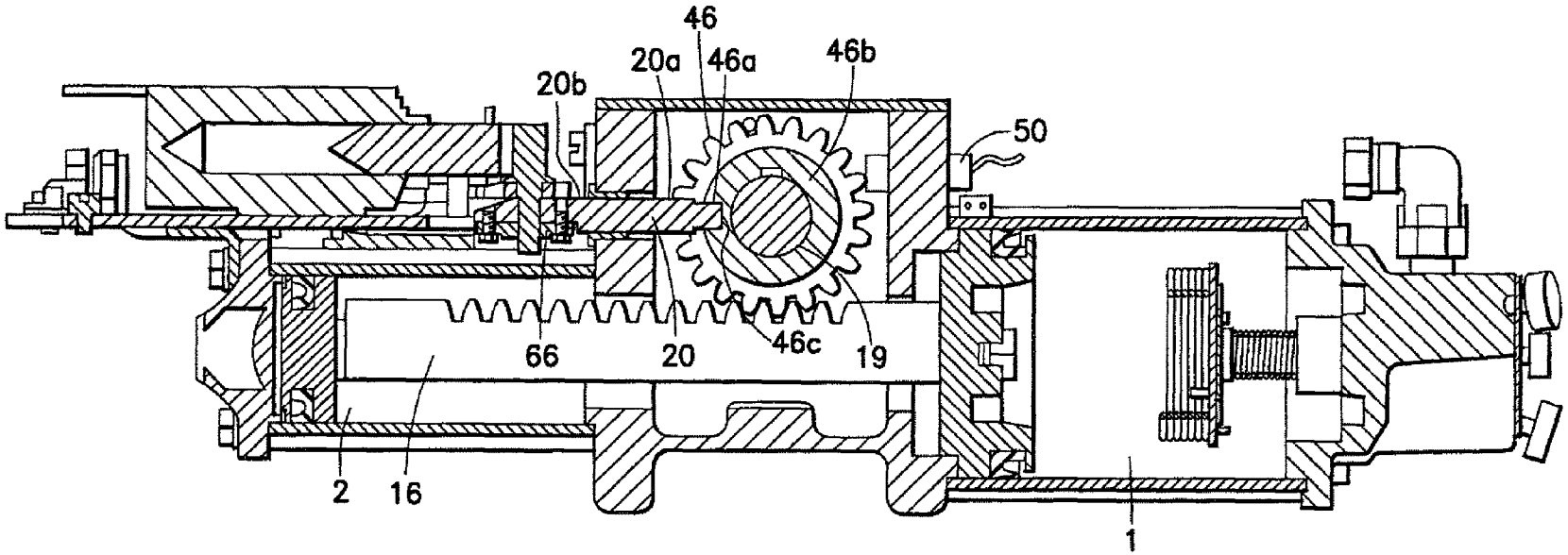
FIG. 5 is a cross-sectional view taken along line C-C of FIG. 2 of the differential engine with the locking mechanism in the "doors locked" position.
Figure 6:
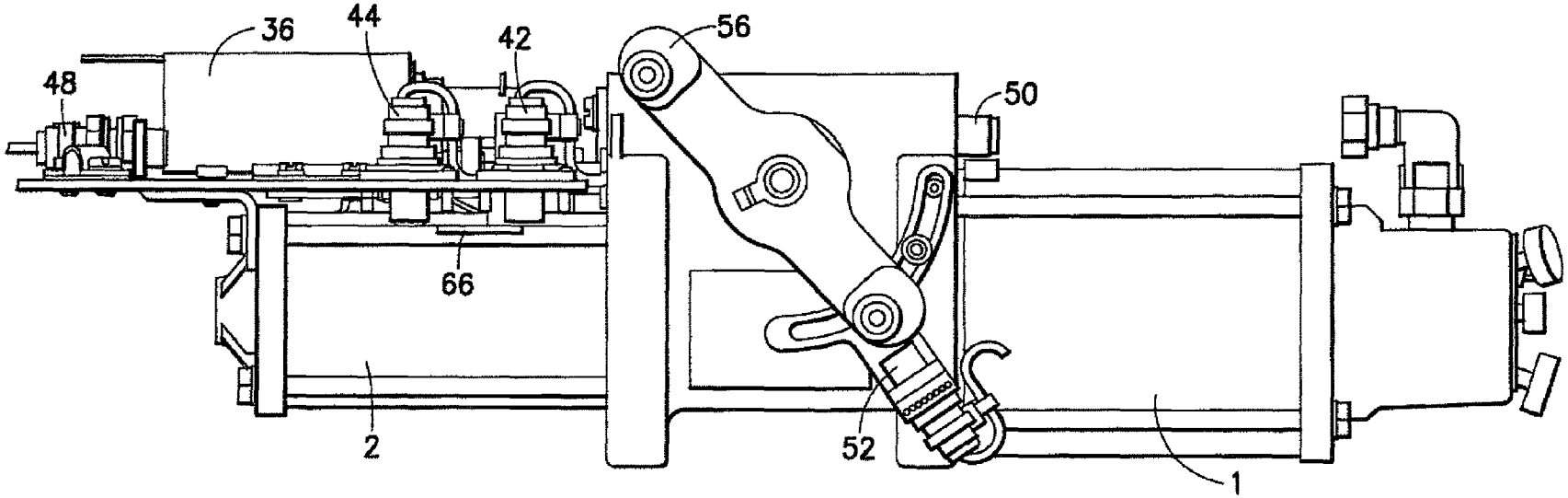
FIG. 6 is a front view "D" in the direction of the arrow "D" of FIG. 2 of the differential engine with the locking mechanism in the "doors locked" position.
Figure 7:
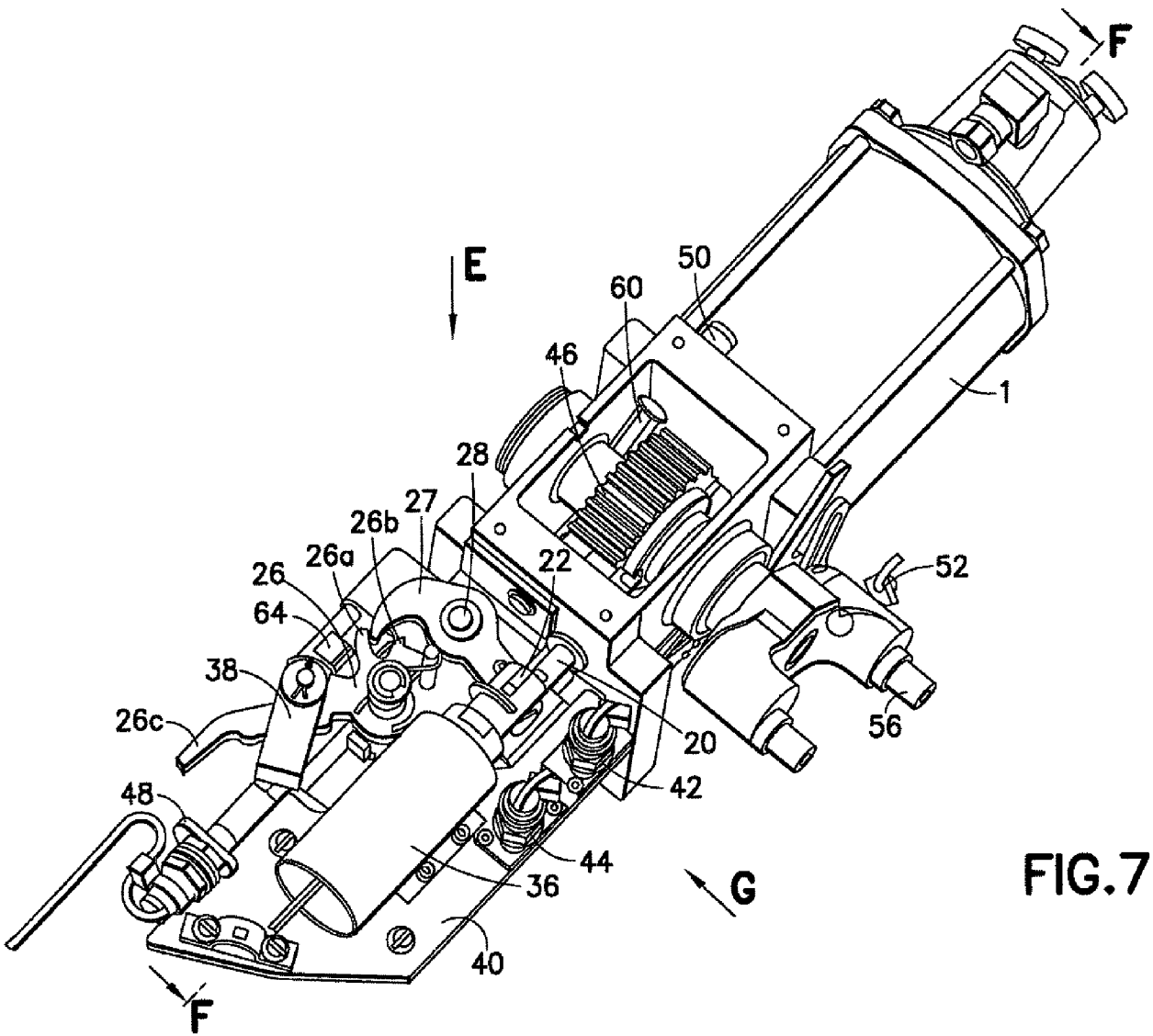
FIG. 7 is an isometric view of the differential engine with the locking mechanism in the "doors opened" position.
Figure 8:
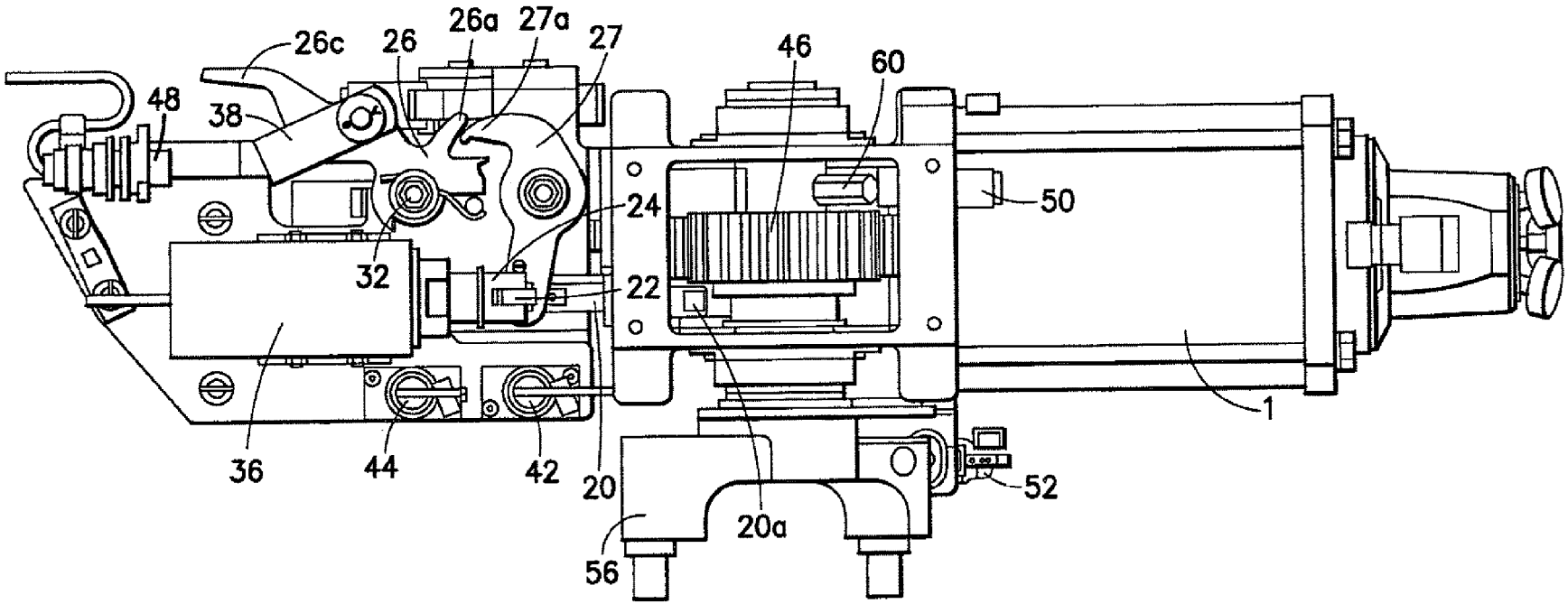
FIG. 8 is a top view "E" in the direction of the arrow "E" of FIG. 7 of the differential engine with the locking mechanism in the "doors opened" position.
Figure 9:
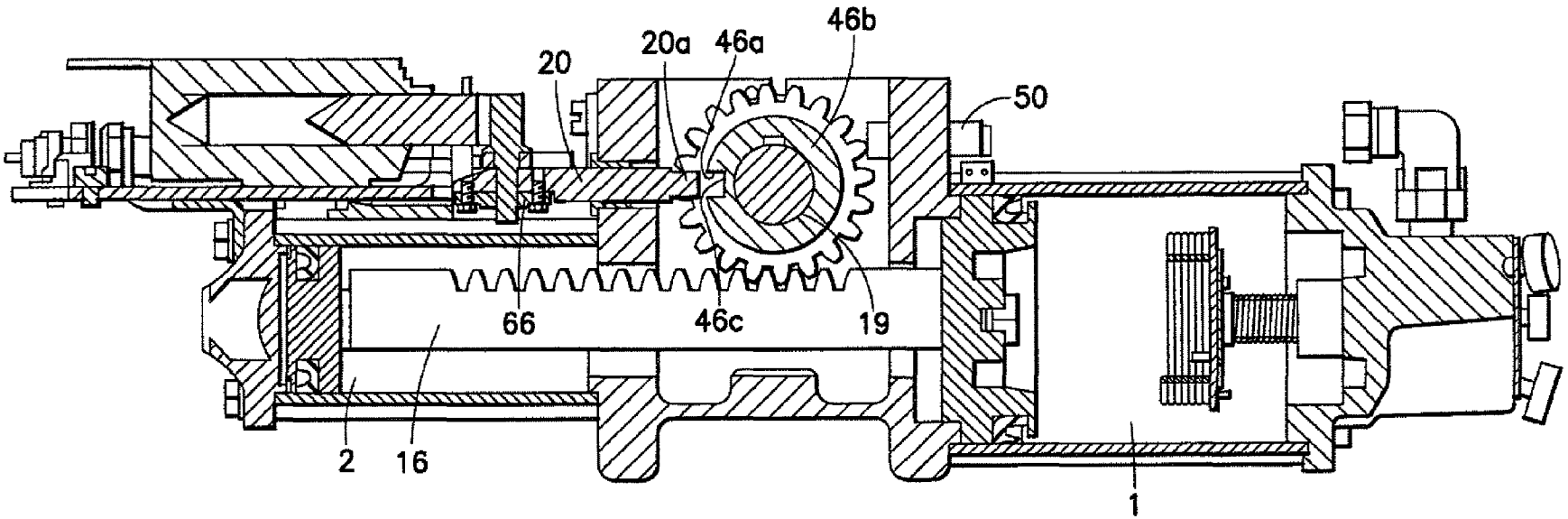
FIG. 9 is a cross-sectional view taken along line F-F of FIG. 7 of the differential engine with the locking mechanism in the "doors opened" position.
Figure 10:
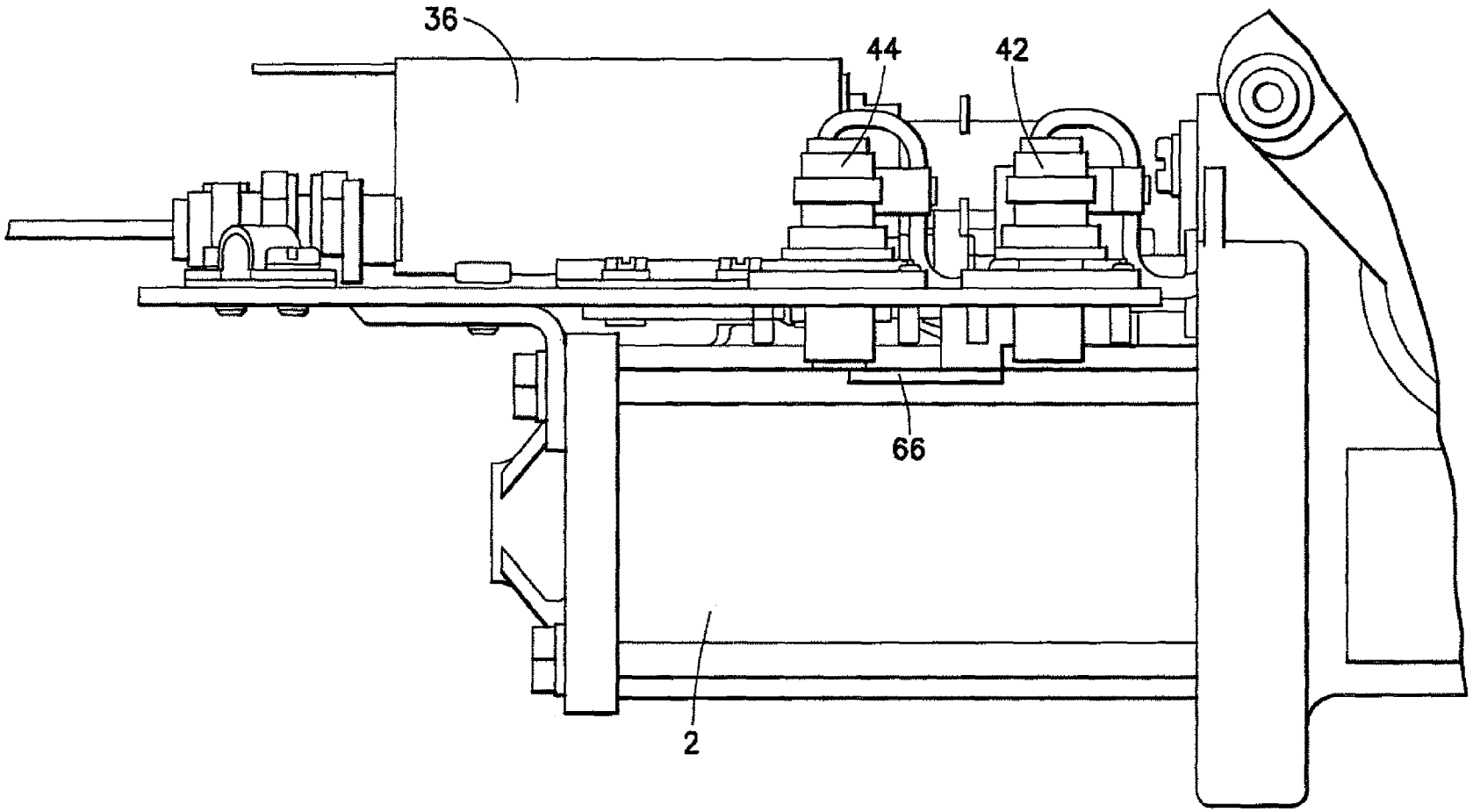
FIG. 10 is a front view "G" in the direction of the arrow "G" of FIG. 7 of the differential engine with the locking mechanism in the "doors opened" position.
Figure 15:
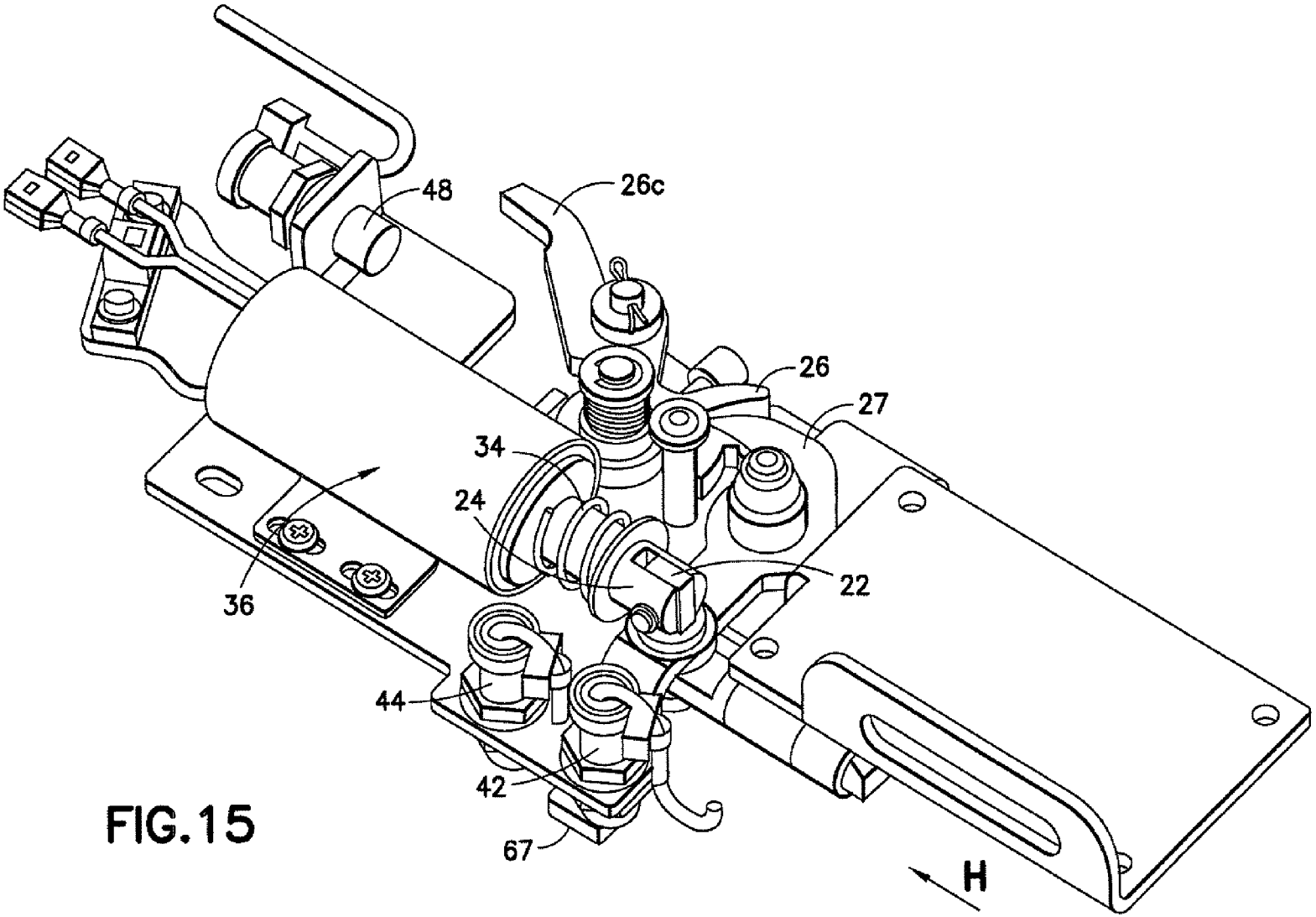
FIG. 15 is an isometric view of an alternative design of the locking mechanism in the "doors locked" position wherein the locking mechanism is removed from the differential engine.
Figure 16:
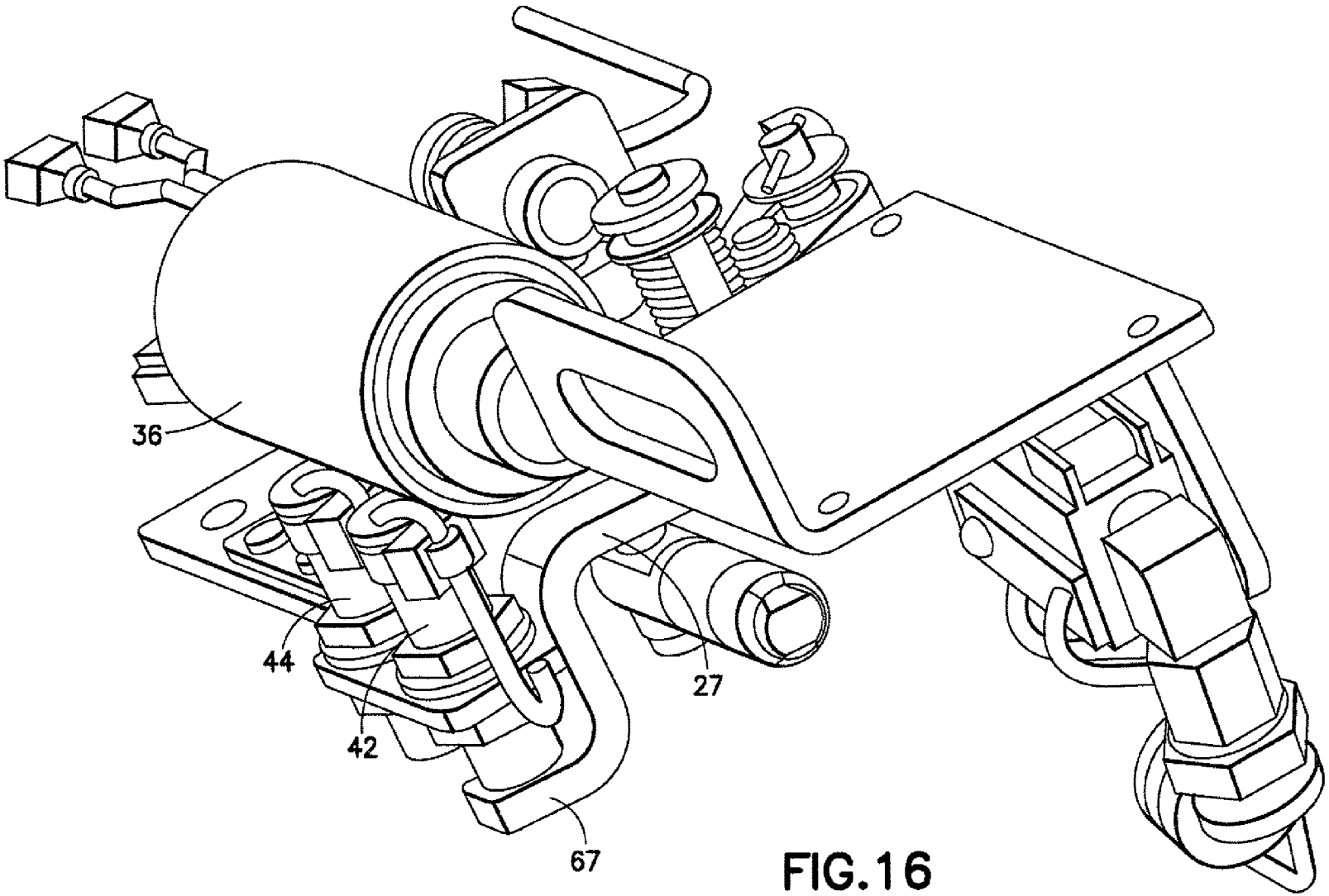
FIG. 16 is an isometric view of the locking mechanism taken in the direction of arrow "H" of FIG. 15.

According to an alternative design, target 66, as shown in FIGS. 5-6, which activates the "doors locked" proximity switch 42, can be replaced with target 67, as shown in FIGS. 15-16. Target 67 is formed from the cam 27. Rotational movement of the cam 27 activates linear movement of the locking rod 20. As shown in FIG. 16, movement of locking mechanism 20 and cam 27 to the locking position causes target 67 to activate the "doors locked" proximity switch 42, which generates a signal that indicates that the differential engine is locked.

Reference is now made to FIGS. 7-10 which show the differential engine with the doors in the "unlocked and open" position. To open the doors, the solenoid in the solenoid assembly 36 is energized by the "door open" command from the vehicle electrical controls and retracts the plunger 24. The motion of the plunger 24 is transferred by the adapter 22 to the locking rod 20, withdrawing the locking rod 20 from the gear 46 in the outward radial direction. A "doors unlocked" proximity switch 44 is activated by the target 66, changing the state of a three-way solenoid valve, not shown, to exhaust air from the large cylinder 1 of the differential engine and initiate door opening. Opening of the doors will stop when a "doors opened" proximity switch 52 is activated by the teeter lever 56.

As discussed in detail above, target 66, located on locking rod 20, can be replaced by target 67, which forms a part of cam 27, as shown in FIGS. 15-16. Rotational movement of cam 27 to the "doors unlocked" position activates the "doors unlocked" proximity switch 44.

During "door closing", a signal from the vehicle electrical controls initiates the door closing process. The necessary condition for initiation is the presence of a signal from the "door unlocked" proximity switch 44. The solenoid in the solenoid assembly 36 is de-energized, and compression spring 34 pushes plunger 24 and locking rod 20 in a radial direction until the locking rod 20 contacts the outside surface of the gear hub 46*b*. When the gear 46 rotates into the fully-closed position, the compression spring 34 causes the locking rod 20 to enter into the aperture 46*a* of the gear hub 46*b*, locking the gear 46.

As shown in FIGS. 11-14, to open the door in case of an emergency, a series of cams 26, 27 are associated with the locking mechanism 100. This series of cams includes a first cam 26 and a second cam 27. The cams 26, 27 are attached to the locking mechanism 100 by any well-known means, such as shafts 28, 30. An emergency cable 62 and an emergency cable attachment 38 are attached to first cam 26 for applying a force to the series of cams 26, 27 causing the series of cams 26, 27 to rotate and cause the locking mechanism 100 to be released. An air dump control lever 64*a* is associated with the series of cams 26, 27, and an air dump valve 64 is controlled by this air dump control lever 64*a*. Rotation of the series of cams 26, 27 causes release of air pressure within the pneumatic cylinders 1, 2, which enables a manual opening of the doors.

Figure 11:
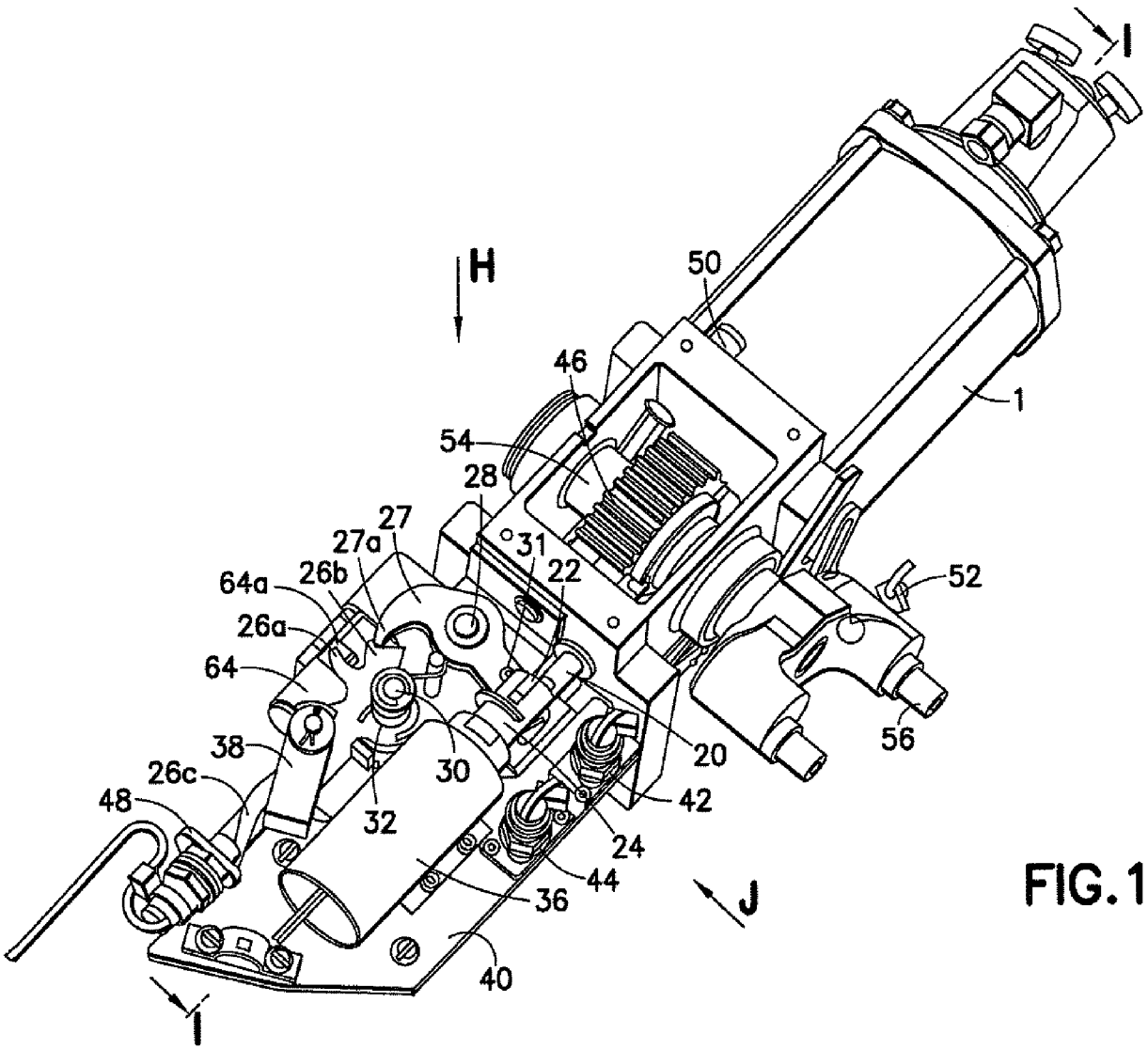
FIG. 11 is an isometric view of the differential engine with the locking mechanism in the "doors emergency opened" position.
Figure 12:
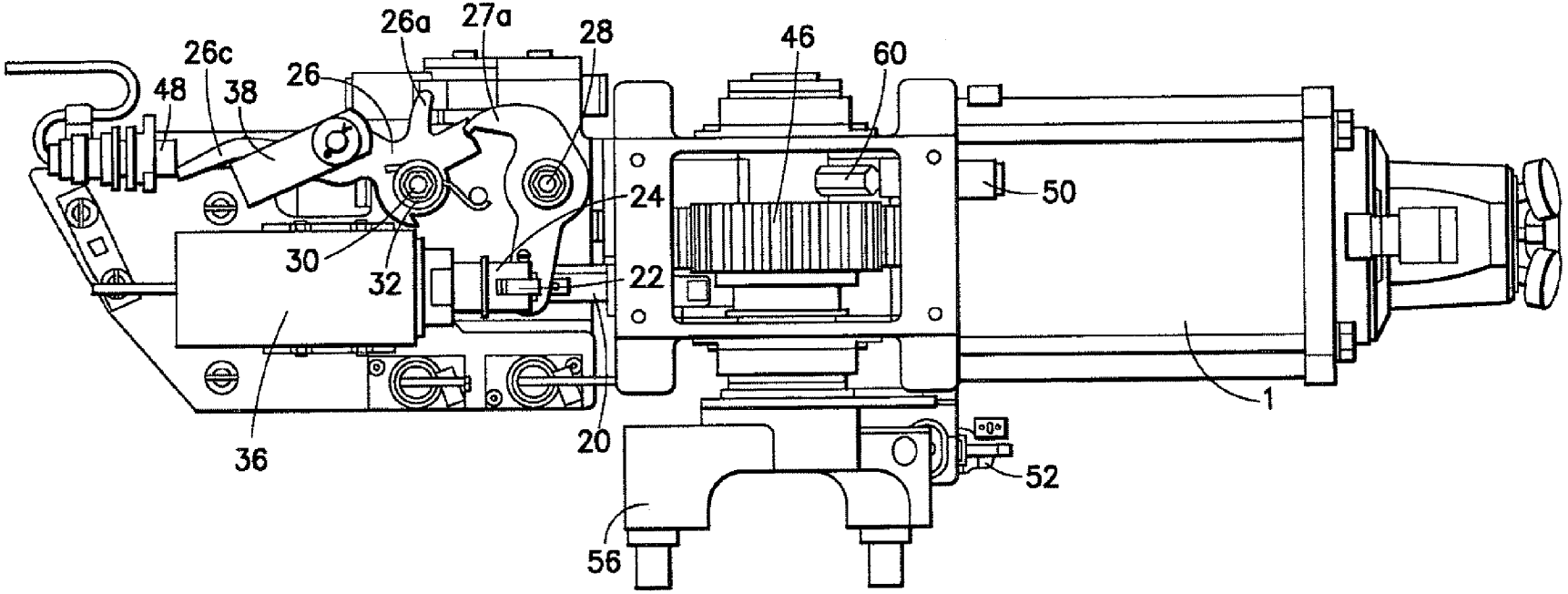
FIG. 12 is a top view "H" in the direction of the arrow "H" of FIG. 11 of the differential engine with the locking mechanism in the "doors emergency opened" position.
Figure 13:
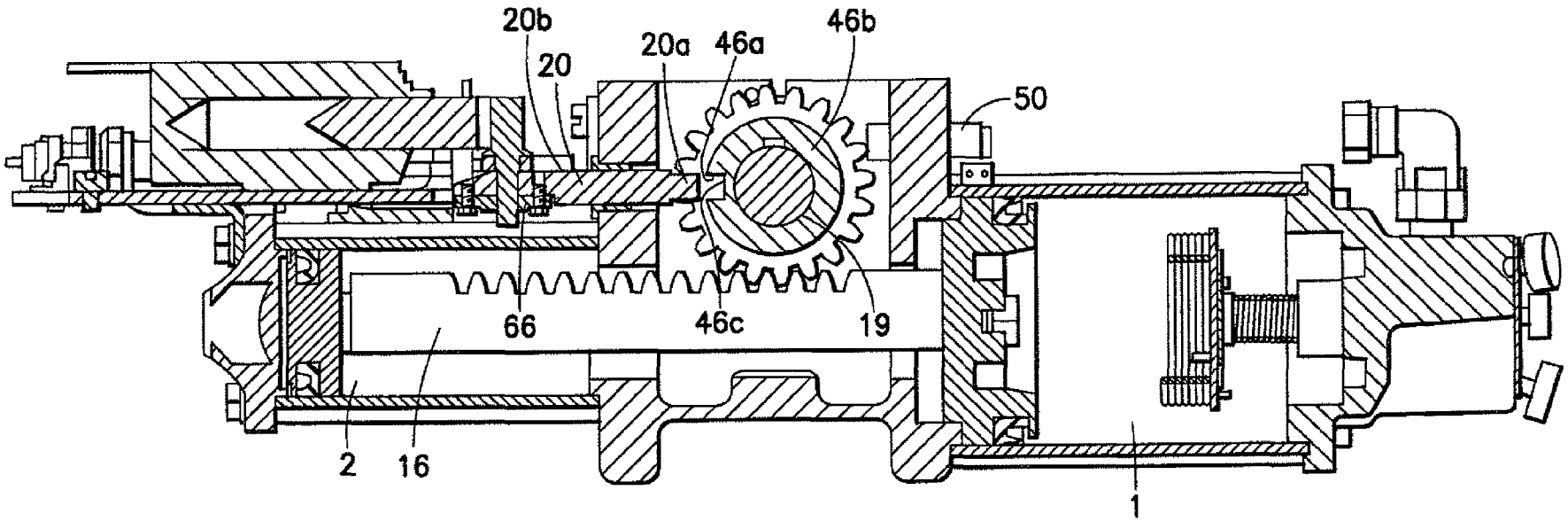
FIG. 13 is a cross-sectional view taken along line I-I of FIG. 11 of the differential engine with the locking mechanism in the "doors emergency opened" position.
Figure 14:
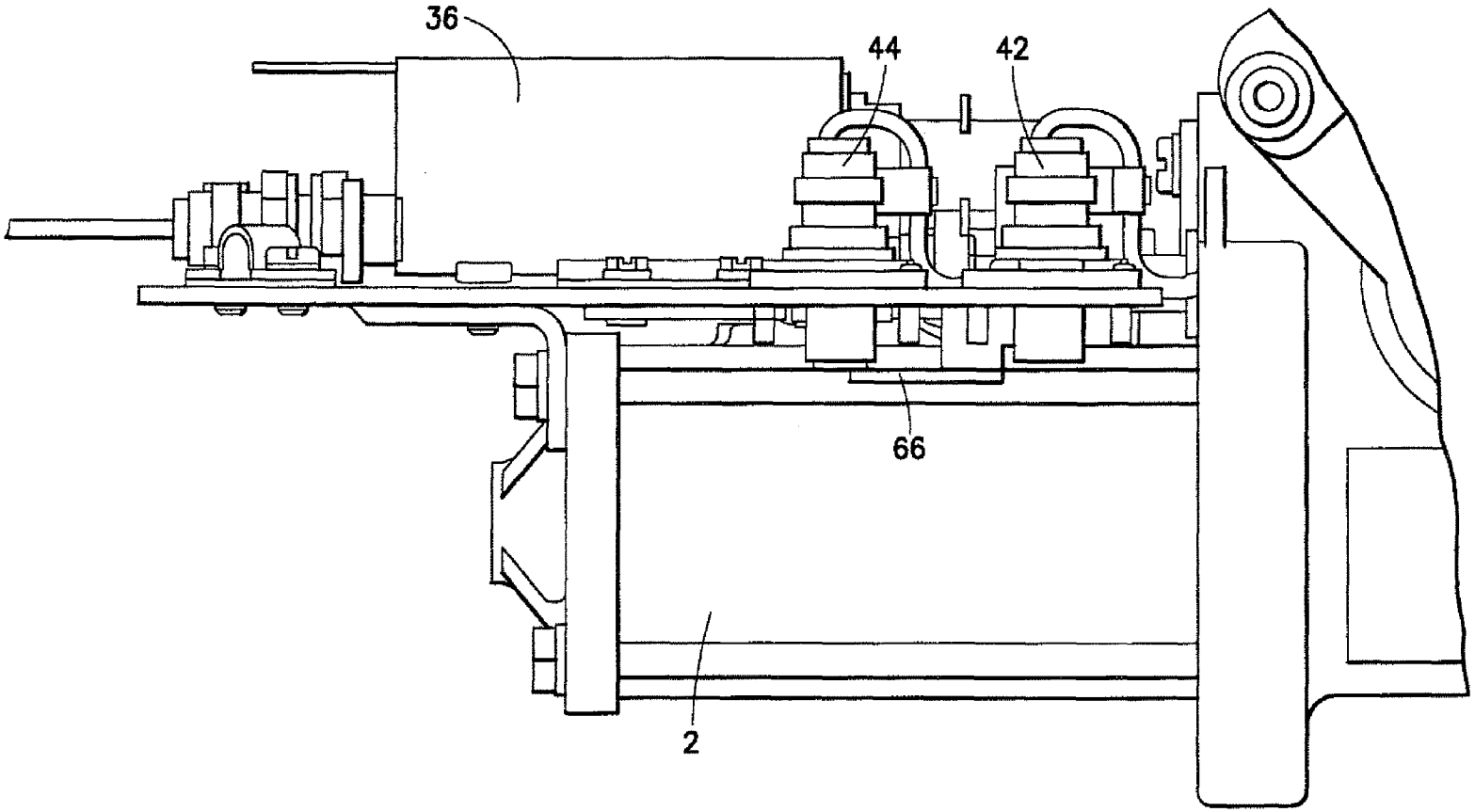
FIG. 14 is a front view "J" in the direction of the arrow "J" of FIG. 11 of the differential engine with the locking mechanism in the "doors emergency opened" position.

The emergency door release functions as follows. A force is applied through an emergency cable 62 and emergency cable attachment 38 to the first cam 26. The first cam 26 includes a beak portion 26*a*, a notch portion 26*b* and a leg portion 26*c*. Second cam 27 includes a finger portion 27*a*, which normally rests within the beak portion 26*a* of first cam 26. Second cam 27 is attached to the adapter 22 by any well-known means, such as a pin 31. The force from the emergency cable 62 causes the first cam 26 to rotate in a counter-clockwise direction, as shown in the figures, causing the rotation of the second cam 27 in the clockwise direction and movement of the finger portion 27*a* out of the beak portion 26*a* of the first cam 26 and into the notch portion 26*b*, as illustrated in FIGS. 11 and 12. Leg portion 26*c* of first cam 26 rotates and actuates an "emergency activated" proximity switch 48. A torsion spring 32 is provided on shaft 30 above and adjacent to first cam 26. Rotation of cams 26, 27 also causes compression of the torsion spring 32. Second cam 27 is constantly engaged with the first cam 26, and "locks" or becomes "jammed" with the first cam 26 at the end of the rotation. Rotation of the second cam 27 in the clockwise direction causes the movement of the locking rod 20, connected to the second cam 27 by the adapter 22, in the outward radial direction, withdrawing the adapter 22 and the locking rod 20 a sufficient amount toward the solenoid assembly 36 to enable unlocking of the gear 46 and opening of the doors. When the rotation of the second cam 27 stops, the cams 26, 27 remain in the "locked" or "jammed together" position. As a result, the locking rod 20 and plunger 24 of the solenoid assembly 36 are maintained in an "unlocked" position. First cam 26 is pressing down on lever 64*a* of the air dump valve 64. Consequently, rotation of the cam 26 activates the lever 64*a* of the air dump valve 64 and the air dump valve 64 releases the air pressure from both of the cylinders 1, 2 of the differential engine, enabling manual opening of the vehicle doors. The leg portion 26*c* of the first cam 26 functions as a target for "emergency activated" proximity switch 48, and, as a result, at the end of the rotation, it activates this switch 48, which generates an "emergency activated" signal for the bus electrical controls. The target 66, connected to the locking rod 20, activates the "door unlocked" proximity switch 44, which generates a "door unlocked" signal. Alternatively, target 67 attached to second cam 27 shown in FIGS. 15-16 can activate the "door unlocked" proximity switch 44.

To reactivate the differential engine and close the doors, the vehicle electrical controls energize the solenoid assembly 36, which retracts the plunger 24 farther into the solenoid assembly 36 and rotates second cam 27 farther in the clockwise direction, pulling the finger portion 27*a* out of notch 26*b*, releasing the first cam 26 from engagement with the second cam 27. The compressed torsion spring 32 returns first cam 26 to the initial position. The "emergency activated" proximity switch 48 is deactivated, and the vehicle electrical controls signal that the engine is ready for the door closing cycle.

After emergency opening of the doors, the door closing cycle can be reactivated by deactivating the solenoid assembly 36, causing the plunger 24 and locking rod 20 to extend from the solenoid assembly 36 such that the leading end 20*a* of the locking rod engages aperture 46*a* of gear 46. The emergency unlocking mechanism and door reactivation mechanism of the invention are such that the door may be remotely closed and locked after an emergency door opening situation without manually contacting the mechanical components of the system to reset the device.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A locking mechanism for use with a differential engine for a power-operated door, said differential engine including a pair of aligned cylinders and a pair of associated pistons having a rack and pinion assembly including a pinion gear, said rack and pinion assembly connected between and controlled by movement of said associated pistons for opening and closing of said door, said locking mechanism comprising:

(a) a locking rod extending in a radial direction relative to the axis of the pinion having a leading end and a trailing end;

(b) a plunger associated with said trailing end of said locking rod wherein movement of said plunger causes extension and retraction of said locking rod with respect to said pinion gear;

(c) a spring member associated with said plunger for maintaining said plunger and said locking rod in an extended position during a door closed position;

(d) said pinion gear having a sidewall portion with an outside hub surface;

(e) an aperture located through the outside surface of said sidewall portion of said gear, said aperture being sized and shaped to receive said leading end of said locking rod when said locking rod is in an extended position to lock said gear in a door closed position; and (f) a linear actuator associated with said plunger for overcoming the spring member to retract said locking rod.

2. The locking mechanism of claim 1 including an adapter for connecting said trailing end of said locking rod to said plunger.

3. The locking mechanism of claim 1 including a door closed proximity switch for generating a door closed signal.

4. The locking mechanism of claim 1 including a target connected to said locking rod for activating a door locked proximity switch which generates a door locked signal.

5. The locking mechanism of claim 1 including a target associated with a cam for activating a door locked proximity switch which generates a door locked signal.

6. The locking mechanism of claim 1 wherein said linear actuator comprises a solenoid assembly associated with said plunger, said solenoid assembly including a solenoid which is activated upon receipt of a door opening signal.

7. The locking mechanism of claim 1 wherein said linear actuator comprises a single-acting pneumatic cylinder having at least one control valve, which is connected to a source of pressurized air, that is activated upon receipt of a door opening signal.

8. The locking mechanism of claim 1 wherein said locking rod includes a target for activating a door opening proximity switch which generates an air exhaust signal for exhausting air from one of said aligned cylinders of the differential engine to initiate a door opening cycle.

9. The locking mechanism of claim 8 including a teeter lever, mounted with respect to said rack and pinion assembly, for opening said door during a door opening cycle and activating the door opened proximity switch upon completion of the door opening cycle.

10. An emergency door opening mechanism for use with a locking mechanism of a differential engine for a power-operated door, said differential engine including a pair of aligned cylinders and a pair of associated pistons having a rack and pinion assembly including a pinion gear, said rack and pinion assembly connected between and controlled by movement of said associated pistons for opening and closing of said door, said emergency door opening mechanism comprising:

(a) a series of cams associated with said locking mechanism;

(b) an emergency cable for applying a force to said series of cams causing said series of cams to rotate and cause said locking mechanism to be released; and (c) an air dump control lever associated with said series of cams and an air dump valve controlled by said air dump control lever for releasing air pressure from said pneumatic cylinders upon rotation of said series of cams wherein release of air pressure enables a manual opening of the doors wherein said locking mechanism includes a locking rod, a plunger associated with said locking rod for causing extension and retraction of said locking rod and a spring member associated with said plunger for maintaining said plunger and said locking rod in an extended position during a door closed position and for contacting and locking said gear during said door closed position.

11. The emergency door opening mechanism of claim 10 wherein said series of cams comprises a first cam associated with said emergency cable, a second cam in rotational engagement with said first cam and a torsion spring cooperating with said first and second cams, said second cam having a portion in contact with said spring member of said plunger and wherein rotation of said first and second cams causes compression of said second cam and compression of said spring member to retract said plunger and said locking rod with respect to said gear.

12. The emergency door opening mechanism of claim 11 wherein said first cam includes a beak portion and a notch portion located below said beak portion.

13. The emergency door opening mechanism of claim 12 wherein said second cam includes a finger portion which rests within said beak portion prior to an emergency door opening command and moves to said notch portion upon rotation of said first cam during an emergency door opening sequence.

14. The emergency door opening mechanism of claim 11 wherein said first cam includes a leg portion for activating an emergency activated proximity switch which generates an emergency activated signal.

15. The emergency door opening mechanism of claim 11 wherein said second cam includes a target for activating a door unlocked proximity switch for generating a door unlocked signal.

16. The emergency door opening mechanism of claim 10 wherein said locking rod includes a target for activating a door unlocked proximity switch for generating a door unlocked signal.

17. The emergency door opening mechanism of claim 10 wherein said emergency door opening mechanism is released through an electrical control signal, causing said door opening mechanism to complete a full door opening cycle, causing said series of cams to rotate to an initial position.

18. The emergency door opening mechanism of claim 17 wherein upon completion of said full door opening cycle, the differential engine may be returned to the door closed position and locked through a remote control signal.

* * * * *